US005505040A

United States Patent [19]

Janssen et al.

[11] Patent Number: 5,505,040

[45] Date of Patent: Apr. 9, 1996

[54] PROCESS AND APPARATUS FOR PRODUCING, FILLING, AND SEALING BAGS

[75] Inventors: Harrie Janssen, Budel-Dorplein; Peter Slenders, Maarheeze; Mark Smeets, Weert, all of Netherlands

[73] Assignee: Robert Bosch GmbH, Stuttgart, Germany

[21] Appl. No.: 317,628

[22] Filed: Oct. 3, 1994

[30] Foreign Application Priority Data

Oct. 19, 1993 [DE] Germany ..... 43 35 577.3

[51] Int. Cl.[6] ..... B65B 9/00

[52] U.S. Cl. ..... 53/451; 53/551

[58] Field of Search ..... 53/451, 551, 552

[56] References Cited

U.S. PATENT DOCUMENTS

| | | | |
|---|---|---|---|
| 2,923,115 | 2/1960 | Frank et al. | 53/551 |
| 3,548,563 | 12/1970 | Leasure | 53/551 |
| 3,552,081 | 1/1971 | Leasure | 53/552 |
| 4,079,662 | 3/1978 | Puccetti et al. | 53/552 |
| 4,442,656 | 4/1984 | Wylie, Sr. | 53/552 |
| 4,829,745 | 5/1989 | Behr et al. | 53/451 |
| 4,965,986 | 10/1990 | Klinkel | 53/551 |
| 5,241,804 | 9/1993 | Tsuruta et al. | 53/551 |
| 5,361,560 | 11/1994 | Sandolo | 53/551 |

FOREIGN PATENT DOCUMENTS 1815029 12/1968 Germany .

*Primary Examiner*—John Sipos
*Assistant Examiner*—Ed Tolan
*Attorney, Agent, or Firm*—Edwin E. Greigg; Ronald E. Greigg

[57] ABSTRACT

A process and apparatus for producing, filling, and sealing bags out of a tube including a molding tube and a traveling inner tube that has a nozzle attached to it, against whose base a square bottom for a bag is folded. The nozzle is moved with a grasping device at the same speed as the feed velocity of the tube and parallel to it. The grasping device is disposed on a transverse seam jaw housing, which for its part can be moved along the feed path of the tube. Using the apparatus according to the invention and the process applicable to it, square bottoms can be folded in bags during a continuous feed of the tube, which gives rise to an especially high output of the apparatus.

20 Claims, 2 Drawing Sheets

PROCESS AND APPARATUS FOR PRODUCING, FILLING, AND SEALING BAGS

BACKGROUND OF THE INVENTION

The invention is based on a process for producing, filling, and sealing bags as defined hereinafter. In a known process of this kind, a tube is formed from an endless foil strip by means of a tube forming device and a longitudinal seam sealer. This tube is adjoined by vacuum controlled conveyor belts, which are disposed on the tube forming device, and fed further by increments of a determined length. Beneath the tube forming device are a stationary square bottomer and a transverse seam sealer, which fold a square bottom in the conveyed tube and adjoining it, form a transverse seam for the bottom. Then the filling of the product into the tube begins. At the same time as the formation of the transverse seam for the bottom, a top transverse seam is formed for the previously fed part of the tube so that a sealed bag is produced, which at the end can be separated from the tube. A disadvantage of the known process is that the tube is not fed continuously, but incrementally, which gives rise to a relatively low output in apparatuses that work according to this process. It would be desirable, however, if one could also fold square bottoms in bags whose tube was continuously fed by the apparatus, which would increase its output.

OBJECT AND SUMMARY OF THE INVENTION

The process for producing, filling, and sealing bags according to the invention has the advantage over the prior art that square bottoms can be folded in a continuously fed foil strip tube. As a result, the apparatuses that work according to this process have a particularly high output.

The characteristics of an apparatus for carrying out the process according to the invention are delineated herein.

Further embodiments and improvements on the apparatus indicated herein are possible by means of the measurements and embodiments given hereinafter.

It is advantageous if the nozzle is movably disposed inside the filling tube and is adapted to its form so that damage to the tube is prevented during the transition from the mould tube to the nozzle.

A movement of the nozzle is achieved absolutely parallel to the transverse seam jaw housing. By means of the use of jaws, which are connected to the transverse seam jaw housing and act with a positive fit on the nozzle.

A coupling of the inner tube to a control cylinder via a rod assembly guarantees a simple and secure lifting of the inner tube in the mould tube and also of the nozzle.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
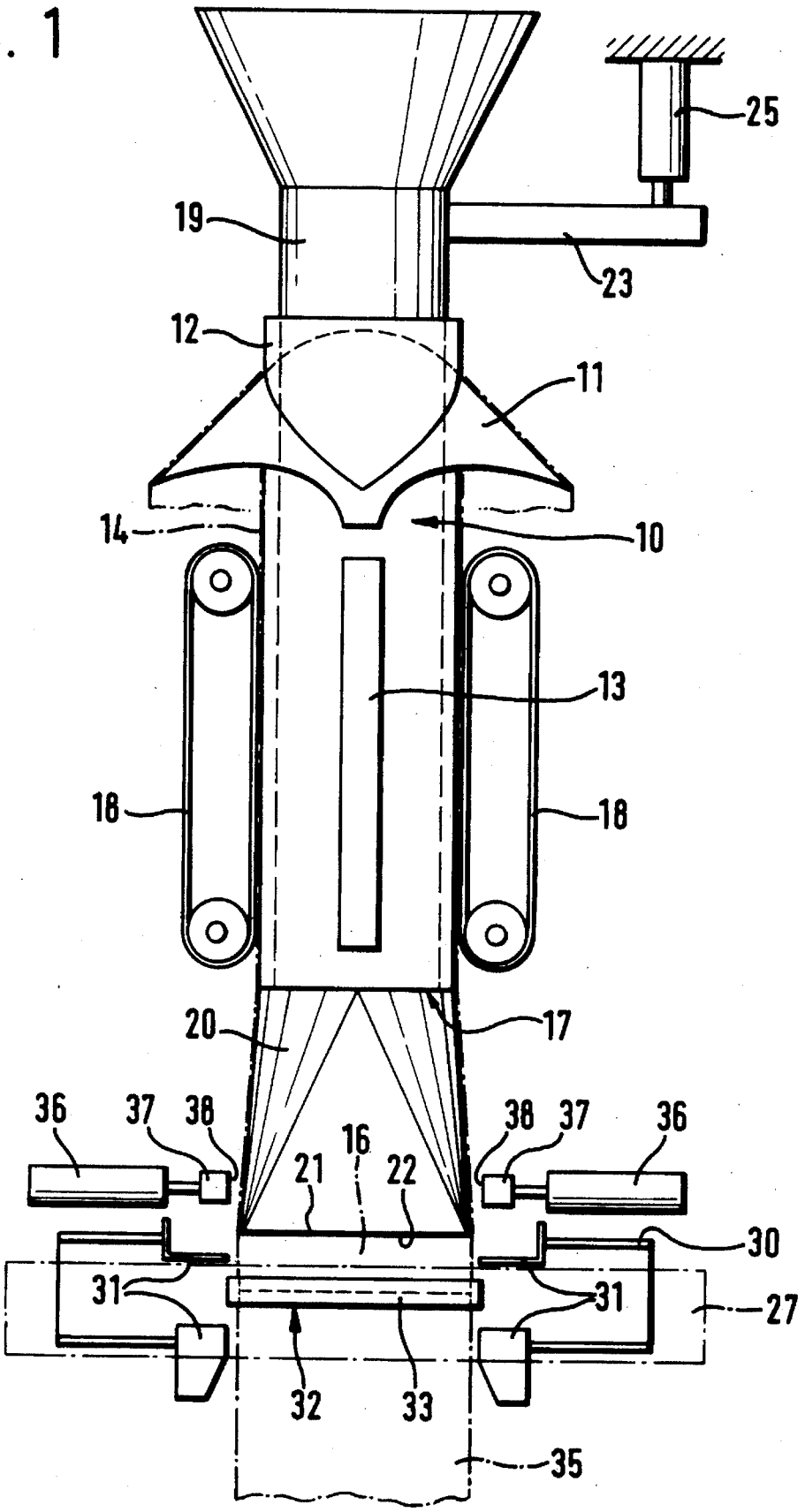
FIG. 1 shows a simplified front view of an apparatus for producing, filling, and sealing bags.

The apparatus (FIG. 1) has a tube forming device 10, which comprises a moulding shoulder 11 and a moulding tube 12, as well as a longitudinal seam sealer 13, with which a foil strip 14 is formed into a tube 16 in a known manner. A withdrawal device for the tube in the form of a vacuum supported conveyor belt 18 is disposed on opposite sides of the moulding tube 12, at the level of the longitudinal seam sealer 13. An inner tube 19 having a nozzle 20 attached to it is disposed in the moulding tube 12 so that it can be moved up and down within a determined region, for example 20 mm. The length of the inner tube 19 having the nozzle 20 is greater than the length of the moulding tube 12. At the outlet 17 on the underside of the moulding tube 12, the one end of the nozzle 20 is fitted to the shape of the moulding tube 12 and so has a round shape, for example, and is virtually encompassed by the moulding tube 12. Consequently, in the transition from the moulding tube 12 to the nozzle 20, there are no edges in particular which could possibly damage the tube 16. The end of the nozzle 20 opposite the inner tube 19 has a base 21 whose shape is adapted to a square bottom to be folded, so it has particularly a rectangular shape. Furthermore an opening 22 is provided in the base 21 for the filling stock. The region between the two ends of the nozzle 20 is embodied so that a continual transition between the two round or rectangular ends is achieved.

The inner tube 19 or the nozzle 20 is coupled via a rod assembly 23 to a pneumatically driven actuating cylinder 25 connected to the apparatus, for example.

Below the nozzle 20, a transverse seam jaw housing 27 is disposed so that it can move up and down in the feed direction of the tube 16. A packaging material folding device 30 having side fold spatulas 31 is fastened to this housing 27. The packaging material folding device 30 can be moved on the transverse seam jaw housing 27 perpendicular to the feed direction of the tube 16. Furthermore, a transverse seam sealer 32 is disposed on the transverse seam jaw housing 27; this seam sealer 32 has transverse seam jaws 33 whose closing motion is synchronized with the movement of the side fold spatulas 31 via a cam mechanism. The transverse seam sealer 32 is associated with a cutting device, not shown, for separating bags 35 from the tube 16.

Above the packaging material folding device 30 there is a grasping device 36 on opposite sides of the nozzle 20, both of which are fastened to the transverse seam jaw housing 27. The grasping devices 36 have for example pneumatically operated jaws 37, whose face ends 38 oriented toward the nozzle 20 are adapted to it so that they have a positive fit.

The manner of function of the apparatus according to the invention is shown in a simplified manner in FIGS. 2–6; the simplicity is particularly on account of the fact that the tube 16 and the bag 35 are not shown.

In an initial position of the apparatus (FIG. 2), the inner tube 19 having the nozzle 20 is in a lifted position so that the nozzle 20 simply emerges from the moulding tube 12. This is achieved by means of the effect of the actuating cylinder 25 at an appropriate vacuum level. The tube 16, which is formed out of the foil strip 14 by means of the longitudinal seam sealer 13, is continuously fed by the conveyor belts 18 via the moulding tube 12 and the nozzle 20. At the same time, the transverse seam jaw housing 27 moves against the feed direction of the tube 16, upward from a lower position; the transverse seam jaws 33, which until now have been in a wide open position and the packaging material folding device 30 coupled with them begin to close just before the course of movement of the transverse seam jaw housing 27 reaches top dead center. In the retrograde acceleration phase of the transverse seam jaw housing 27 just after reaching the upper turning point, the feed velocity of the tube 16 is adapted to the speed of the transverse seam jaw housing 27 by means of the conveyor belts 18. If the speeds of the transverse seam jaw housing 27 and the tube 16 are the same, the necessary excess length of the tube 16 below the base 21 of the nozzle 20 is available for the formation of the square bottom. At the same time the jaws 37 of the grasping devices 36, which were previously in a returning position, are triggered and reach positive fit contact with the nozzle 20, the tube 16 acting as a liner between them (FIG. 3).

Figures 2, 3, 4, 5, 6:
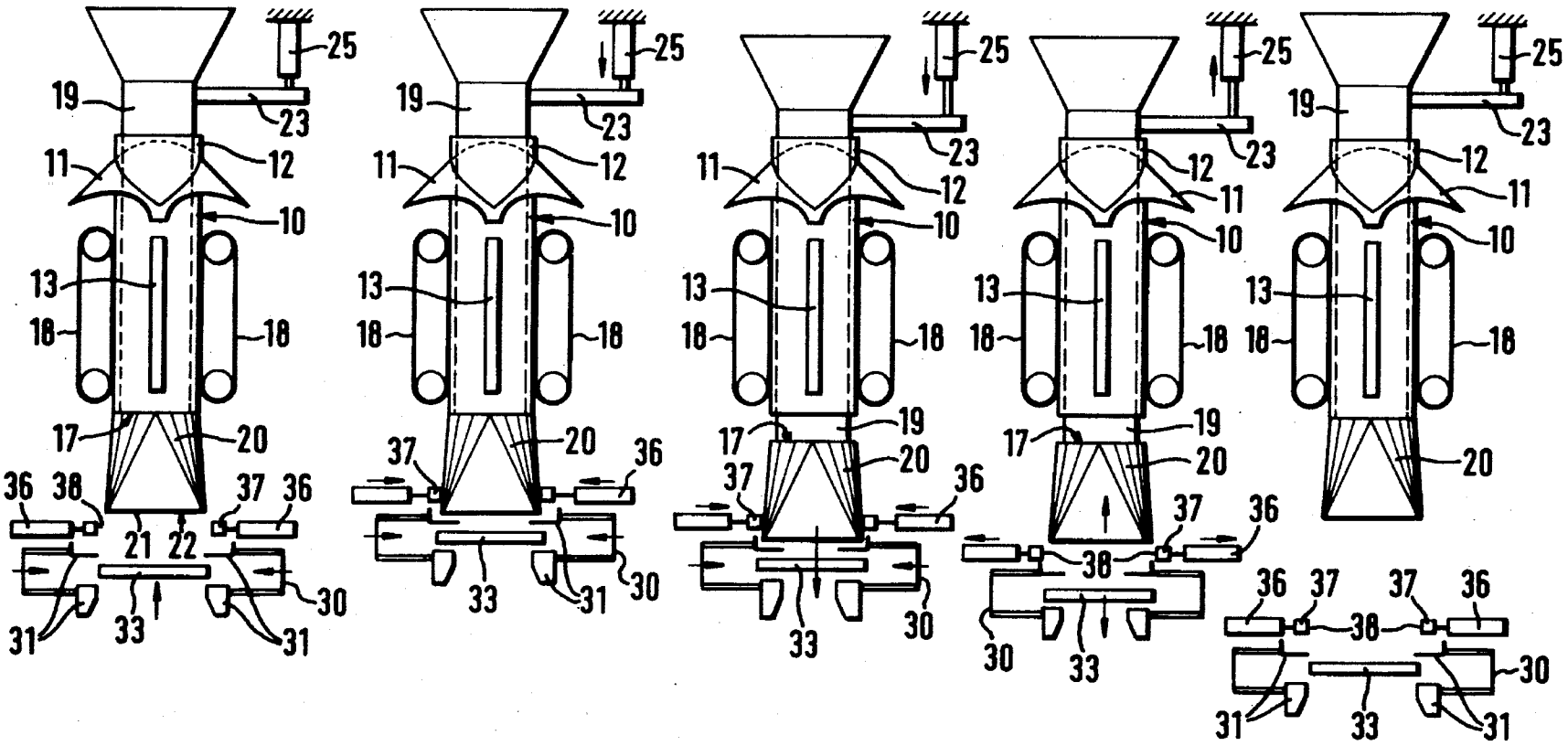
FIGS. 2–6 show simplified front views of the apparatus according to FIG. 1 during different phases of bag production.

After that, the actuating cylinder 25 is ventilated and at the same time the nozzle 20 is moved from the transverse seam jaw housing 27 parallel to it at a speed that corresponds to the feed velocity of the tube 16 (FIG. 4). Consequently, a constant overhang of the tube 16 as regards the base 21 ensues during the downward motion of the nozzle 20 and the transverse seam jaw housing 27. In this phase, the packaging material folding device 30 takes the tube overhang and, with the aid of the base, folds it into a square bottom, and at the end, a transverse seam is formed by the transverse seam jaws 33. At the same time as the formation of the transverse seam, a top transverse seam is formed on the previously produced bag 35, and it is separated from the tube 16 by means of the cutting device. Then, as soon as the transverse seam jaws 33 are closed, a filling stock is placed in the tube 16 by means of the inner tube 19. Finally, the jaws 37 are returned to their original position and the nozzle 20 begins to rise, by means of a corresponding vacuum in the actuation cylinder 25, until it has reached its original, lifted position in the moulding tube 12 again (FIG. 5). The transverse seam jaw housing 27 is now just before its lower turning point, during which the side fold spatulas 31 of the packaging material folding device 30 are swiveled back (FIG. 6) and the transverse seam jaws 33 start to open. At the lower turning point of the transverse seam jaw housing 27, the transverse seam jaws 33 are completely open. Now the transverse seam jaw housing 27 starts its upward motion once more and the above described process happens over again.

It is further emphasized that the transverse seam at the base of the bag 35 can be displaced by means of an additional mechanical device or by means of compressed air, by means of which a flat bottom is produced.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A process for producing, filling, and sealing bags (35) by means of a tube forming device (10) and a longitudinal seam sealer (13) which comprises continuously feeding an endless foil strip (14) along said tube forming device (10) by at least one withdrawal device (18) to form said endless foil strip into a foil tube (16), separating bags (35) from said foil tube by a cutting device connected to a transverse seam sealer (32), continuously feeding the tube (16) relative to a nozzle (20), moving the nozzle down in a determined region of the feed path of the tube (16), at the same speed inside and parallel to the tube (16); in that during this determined region of the feed path, forming a square bottom which is folded by means of a folding device (30) with an excess length of the tube (16) folded against a base (21) of the nozzle (20) while moving the nozzle (30) and the transverse seam sealer (32) attached to it at the same speed as the tube (16); and finally, returning the nozzle (20) to an original, lifted position, during which a filling stock is placed in the tube (16) thus formed.

2. An apparatus for producing, filling, and sealing bags, having a tube forming device (10) which comprises a molding shoulder (11) and a molding tube (12) for forming a foil tube (16) out of an endless foil strip (14), a longitudinal seam sealer (13), at least one foil strip withdrawal device (18) for the tube (16) that is formed, a transverse seam sealer (32) and a folding device (30) positioned relative to said tube (16) for forming a square bottom on one end of the tube (16), an inner tube (19) which is attached to a nozzle (20), said inner tube (19) and said attached nozzle (20) are disposed on the tube forming device (10) and moved up and down on the tube forming device (10); a nozzle and bag grasping device (36) is associated with the nozzle (20) which moves the bag with the nozzle (20) downwardly in a determined region of the feed path of the tube (16), synchronous with its speed and in its feed direction; the folding device (30) is connected to the transverse seam sealer (32); and the folding device (30) and the transverse seam sealer (32) are moved up and down along the feed path of the tube (16) as the tube (16) is continuously moved in a downward direction by the at least one foil strip withdrawal device.

3. An apparatus according to claim 2, in which the shape of the nozzle (20) is adapted on one end relative to the molding tube (12) and on its other end adapted to the square bottom to be folded.

4. An apparatus according to claim 2, in which in the region of its base (21), the nozzle (20) has an opening (22) for the filling stock.

5. An apparatus according to claim 3, in which in the region of its base (21), the nozzle (20) has an opening (22) for the filling stock.

6. An apparatus according to claim 2, in which the nozzle (20) is nearly form fittingly encompassed by the molding tube (12) in the region of the nozzle's outlet (17) from the molding tube (12).

7. An apparatus according to claim 3, in which the nozzle (20) is nearly form fittingly encompassed by the molding tube (12) in the region of the nozzle's outlet (17) from the molding tube (12).

8. An apparatus according to claim 4, in which the nozzle (20) is nearly form fittingly encompassed by the molding tube (12) in the region of the nozzle's outlet (17) from the molding tube (12).

9. An apparatus according to claim 2, in which the device for moving the nozzle (20) comprises at least two grasping devices (36), which are attached to the transverse seam sealer (32) on both sides of the nozzle (20), and the grasping devices (36) have jaws (37), which can be moved perpendicular to the feed direction of the tube (16), whose face ends (38) are form fittingly adapted to the shape of the nozzle (20).

10. An apparatus according to claim 3, in which the device for moving the nozzle (20) comprises at least two grasping devices (36), which are attached to the transverse seam sealer (32) on both sides of the nozzle (20), and the grasping devices (36) have jaws (37), which can be moved perpendicular to the feed direction of the tube (16), whose face ends (38) are form fittingly adapted to the shape of the nozzle (20).

11. An apparatus according to claim 4, in which the device for moving the nozzle (20) comprises at least two grasping devices (36), which are attached to the transverse seam sealer (32) on both sides of the nozzle (20), and the grasping devices (36) have jaws (37), which can be moved perpendicular to the feed direction of the tube (16), whose face ends (38) are form fittingly adapted to the shape of the nozzle (20).

12. An apparatus according to claim 5, in which the device for moving the nozzle (20) comprises at least two grasping devices (36), which are attached to the transverse seam sealer (32) on both sides of the nozzle (20), and the grasping devices (36) have jaws (37), which can be moved perpendicular to the feed direction of the tube (16), whose face ends (38) are form fittingly adapted to the shape of the nozzle (20).

13. An apparatus according to claim 2, in which the inner tube (19) is connected via a rod assembly (23) to an actuating cylinder (25) for the purpose of lifting the inner tube (19) in the molding tube (12).

14. An apparatus according to claim 3, in which the inner tube (19) is connected via a rod assembly (23) to an actuating cylinder (25) for the purpose of lifting the inner tube (19) in the molding tube (12).

15. An apparatus according to claim 4, in which the inner tube (19) is connected via a rod assembly (23) to an actuating cylinder (25) for the purpose of lifting the inner tube (19) in the molding tube (12).

16. An apparatus according to claim 5, in which the inner tube (19) is connected via a rod assembly (23) to an actuating cylinder (25) for the purpose of lifting the inner tube (19) in the molding tube (12).

17. An apparatus according to claim 6, in which the inner tube (19) is connected via a rod assembly (23) to an actuating cylinder (25) for the purpose of lifting the inner tube (19) in the molding tube (12).

18. An apparatus according to claim 7, in which the inner tube (19) is connected via a rod assembly (23) to an actuating cylinder (25) for the purpose of lifting the inner tube (19) in the molding tube (12).

19. An apparatus according to claim 8, in which the inner tube (19) is connected via a rod assembly (23) to an actuating cylinder (25) for the purpose of lifting the inner tube (19) in the molding tube (12).

20. An apparatus according to claim 9, in which the inner tube (19) is connected via a rod assembly (23) to an actuating cylinder (25) for the purpose of lifting the inner tube (19) in the molding tube (12).

* * * * *